US007251836B2

(12) United States Patent
Santiago

(10) Patent No.: US 7,251,836 B2
(45) Date of Patent: Aug. 7, 2007

(54) FINGER COVER

(76) Inventor: Wanda Santiago, 3001 Birmingham Blvd., Orlando, FL (US) 32829

( * ) Notice: Subject to any disclaimer, the term of this patent is extended or adjusted under 35 U.S.C. 154(b) by 278 days.

(21) Appl. No.: 10/863,688

(22) Filed: Jun. 8, 2004

(65) Prior Publication Data

US 2005/0268369 A1 Dec. 8, 2005

(51) Int. Cl.
*A41D 13/08* (2006.01)

(52) U.S. Cl. ..... 2/21; 223/101

(58) Field of Classification Search ..... 2/20, 2/21, 16, 159, 161.1, 161.8, 161.3; 128/880, 128/878; 223/101; 602/21, 22, 63
See application file for complete search history.

(56) References Cited

U.S. PATENT DOCUMENTS 3,972,325 A 8/1976 Bluestone
4,694,843 A 9/1987 Casenhiser
4,763,940 A * 8/1988 Held ..... 294/25
4,972,857 A 11/1990 Stewart et al.
5,186,189 A 2/1993 Harris
D334,085 S 3/1993 Neimann
D335,938 S 5/1993 Kam
5,282,276 A 2/1994 Preiose
D405,557 S 2/1999 Lindsay
6,409,059 B1 6/2002 Calvert
6,647,549 B2 11/2003 McDevitt et al.
6,839,905 B1 * 1/2005 Bruder et al. ..... 2/21

* cited by examiner

*Primary Examiner*—Tejash Patel
(74) *Attorney, Agent, or Firm*—Christine O. McLeod; Beusse Wolter Sanks Mora & Maire

(57) ABSTRACT

A finger cover for providing additional friction when handing paper and protection a user's fingernail is provided. The finger cover includes an elongated tubular sleeve having open ends for receiving a user's finger, whereby the open ends accommodate users with long fingernails; and a gripping surface on an outer surface of the tubular sleeve for providing additional friction when handing paper. The invention also includes a fingernail protection portion held in place by the sleeve. The fingernail protection portion is substantially planar in shape and includes a horizontal slit located between its ends for insertion of a user's fingernail therethrough.

11 Claims, 3 Drawing Sheets

FINGER COVER

TECHNICAL FIELD

The invention is broadly directed to a finger cover used in office settings when counting, sorting and separating paper. More specifically, the invention is directed to a finger cover that will accommodate users with long fingernails.

BACKGROUND OF THE INVENTION

Rubber fingertip covers such as the Swingline® Parr Rubber Finger Tips are used by office workers for counting, sorting and separating paper. The Rubber Finger Tips comprise a rubber sleeve with a closed end that fits over a finger of a wearer, similar to a thimble. However, this type of fingertip cover will not accommodate a user with long fingernails.

The Swingline® Gripeez™ Finger Pads are an alternate type of fingertip that has an extended continuous tubular sheath that fits over both the finger and fingernail. The Gripeez™ Finger Pads also include a closed end that encompasses the fingernail. The closed end limits the range of nail lengths that the device will accommodate.

Other finger/fingernail protective devices already proposed include U.S. Pat. Nos. 3,972,325; 4,972,857; 5,186,189; 5,282,276; D334,085; D335,938; D405,557. However, none of these devices provide a finger cover that protects a fingertip and/or fingertip and fingernail from damage while being further capable of accommodating users with long fingernails, regardless of length.

Accordingly, there is a need in the art for a finger cover that protects a fingertip and/or fingertip and fingernail from damage, and further is capable of accommodating users with long fingernails, regardless of length.

All patents, patent applications, provisional applications, and publications referred to or cited herein, or from which a claim for benefit of priority has been made, are incorporated herein by reference in their entirety to the extent they are not inconsistent with the explicit teachings of this specification.

SUMMARY OF THE INVENTION

The present invention solves the need in the art by providing a finger cover for use in office settings when counting, sorting and separating paper that accommodates users with long fingernails (natural or artificial—e.g., acrylic), regardless of length. The invention further provides non-slip gripping surfaces and improved protection at the fingertips.

Specifically, an embodiment of the invention comprises a finger cover for providing additional friction when handing paper having an elongated tubular sleeve having an open distal end and an open proximal end for receiving a user's finger, whereby the open distal end accommodates users with long fingernails; and a gripping surface on an outer surface of the tubular sleeve for providing additional friction when handing paper. The finger cover may also include a lip portion along said distal and proximal ends. The gripping surface includes a plurality of raised bumps or a rough surface, or the like. The sleeve is made of flexible material such as natural gum or silicone rubber, soft plastic, polyvinyl chloride, or an elastomer-impregnated material.

In another embodiment, the finger cover includes a fingernail protection portion held in place by the sleeve. The fingernail protection portion has a substantially planar body portion with a downwardly convex curvature along the vertical edges to approximate the curvature of a fingernail. It is preferably made of resilient material (transparent, semi-transparent, or opaque) to resist breakage. The fingernail protection portion may also include as least one visible indicator to serve as a guideline for trimming the length of the fingernail protection portion or the nail underneath. A horizontal slit is located between distal and proximal ends of the fingernail protection portion for insertion of a user's fingernail therethrough so that the distal end of the fingernail protection portion rests under the tip of a user's fingernail and the proximal end of the fingernail protection portion rests atop a user's fingernail at or about the nail base. The slit may also include a padded edge for cushioning.

The fingernail protection portion held in place by the sleeve using ordinary frictional gripping or with an attachment device(s). In an embodiment, the attachment device includes mating attachment devices on the sleeve and the fingernail protection portion. For example, the mating attachment devices include at least one protruding knob on the proximal end of said fingernail protection portion and at least one mating opening in the sleeve. Other examples include hook and loop material (i.e., Velcro®) or frictional gripping surfaces.

The finger cover provides a gripping surface for use in office settings when counting, sorting and separating paper. It also accommodates users with long fingernails, regardless of length by having open ends. It also has the advantage of providing protection for fingernails.

Other aspects and advantages of the invention will become apparent from the following detailed description taken in conjunction with the accompanying drawings, illustrating, by way of example, the principles of the invention.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF INVENTION

Reference is now made to embodiments of the inventive finger cover, as shown in FIGS. 1-7 of the drawings.

Figure 1:
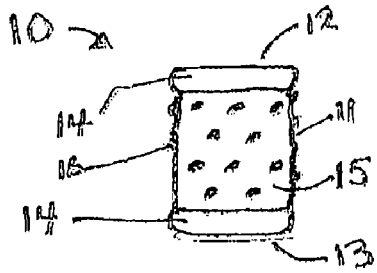
FIG. 1 is a front view of a finger cover in accordance with an embodiment of the present invention.
Figure 2:
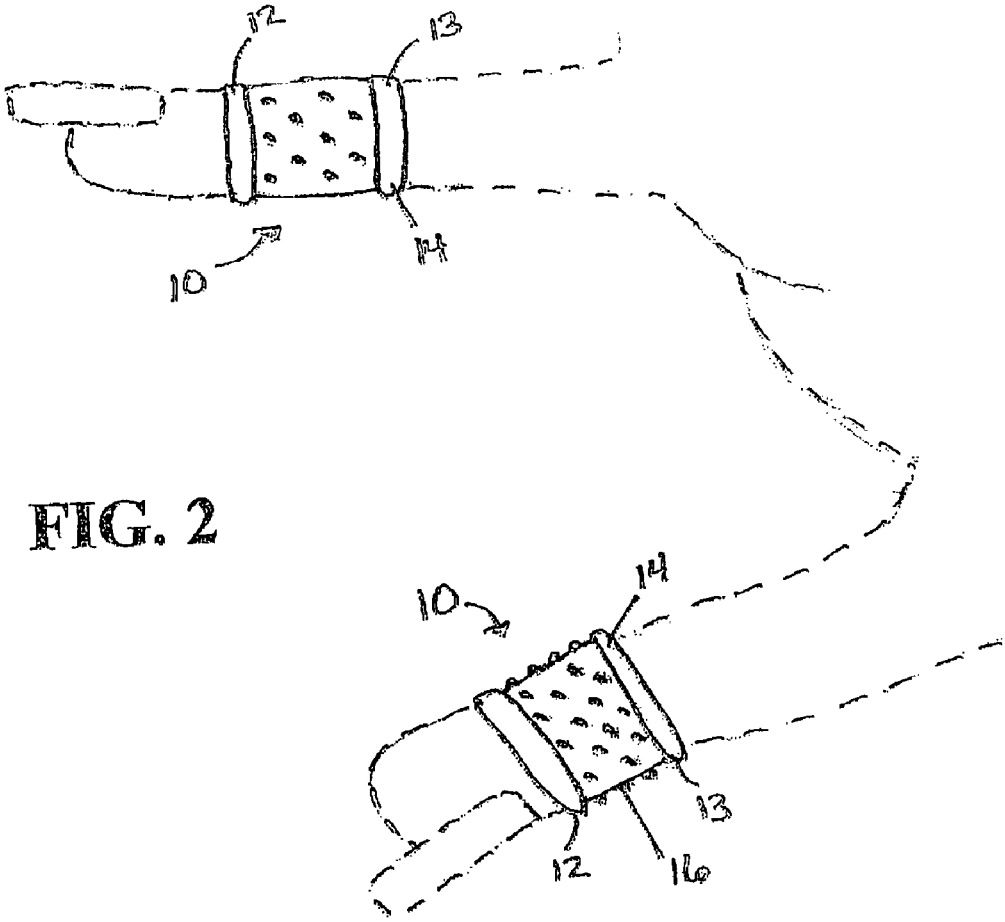
FIG. 2 is a side perspective view of the finger cover of FIG. 1 showing how it would be worn on the finger and thumb of a user.
Figure 3A:
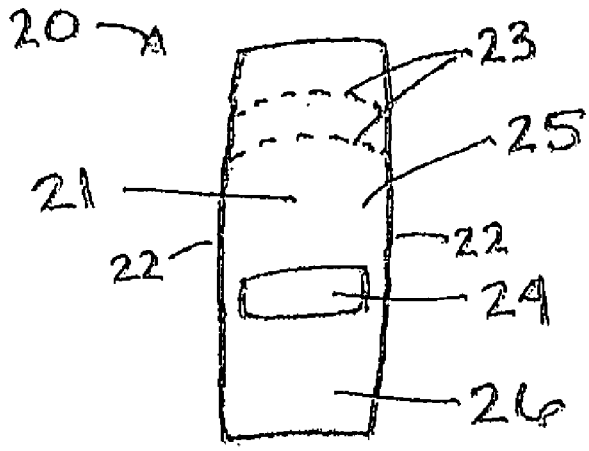
FIG. 3*a* is a front view of a fingernail protection portion of a finger cover in accordance with an alternate embodiment of the present invention.
Figure 3B:
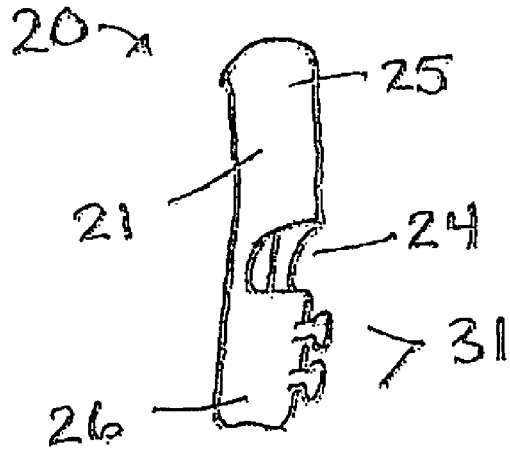
FIG. 3*b* is a side view of a fingernail protection portion of a finger cover in accordance with an alternate embodiment of the present invention further having an attachment device.
Figure 4:
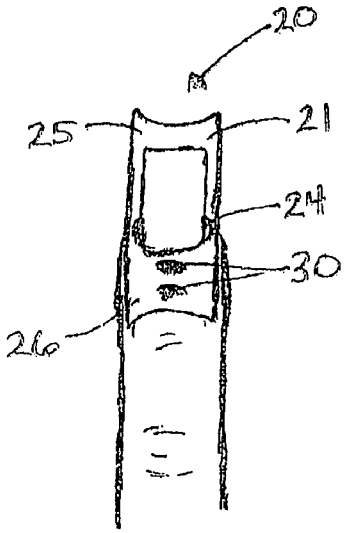
FIG. 4 is a front perspective view of the fingernail protection portion of FIG. 3 showing how it would be placed on the finger of a user.
Figure 5:
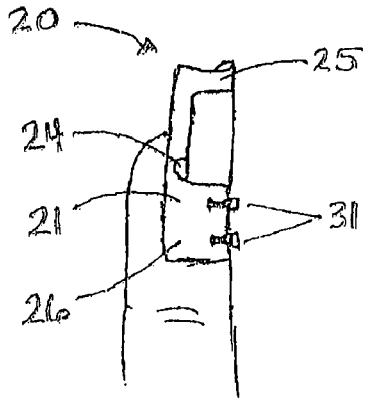
FIG. 5 is a side perspective view of the fingernail protection portion of FIG. 3 showing how it would be placed on the finger of a user.
Figure 6:
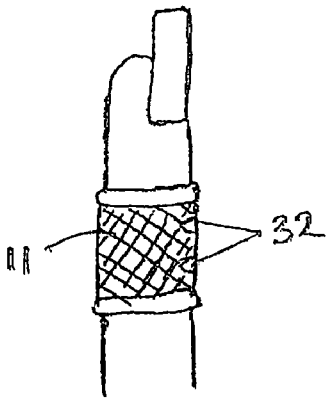
FIG. 6 is a side perspective view of the finger cover of FIG. 1 further having an attachment device.
Figure 7:
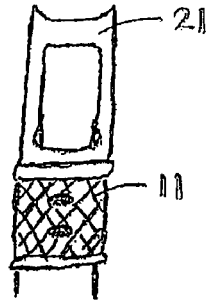
FIG. 7 is a front perspective view of the fingernail protection portion of FIG. 3*b* showing how it would be placed on the finger of a user with the finger cover of FIG. 6.

In a first embodiment of the invention, as shown in FIGS. 1-2, a finger cover 10 is provided. The cover 10 has the basic form of an elongate, continuous tubular sleeve 11, open at its front end 12 and open at the opposite, rear end 13. The sleeve 11 is sized to mount over the distal phalanx of a finger and is generally positioned on or about the distal phalanx and/or proximal phalanx of a finger, or over the distal interphalangeal joint. Generally, a user will wear a finger cover over each of the index finger and thumb to facilitate handling paper, although a user may choose to wear the finger cover on any number of fingers.

The sleeve 11 is of material sufficiently flexible and soft so that it may easily slip onto and comfortably encircle a finger approximate to the outer joint thereof (such as that indicated by the phantom lines in FIG. 2). Examples of suitable material include natural gum or silicone rubber, soft plastic, polyvinyl chloride, or an elastomer-impregnated material or the like.

The respective ends 12, 13 may simply terminate at either end of the sleeve 11 or may further include a lip portion 14 around the circumference to reinforce the ends 12, 13 and allow for easier placement on the finger. The tubular sleeve 11 may be substantially symmetrical so that it can be worn with either of its ends 12, 13, as the front end. Alternately, the tubular sleeve may taper toward its front end 12 to more closely fit the contour of the inserted finger.

The open front end 12 allows for a protruding fingernail (natural or artificial—e.g. acrylic), regardless of its size. This has the unique advantage of allowing users with long, polished, or sensitive fingernails to use the fingertip cover 10 for counting, sorting, filing, and separating paper and then continue with typing, word processing, and the like, without having to remove the finger cover 10. Most importantly, the open end 12 will not interfere with the fingernail.

The outer surface 15 is preferably provided with a gripping surface (i.e., texturized surface) to facilitate handling paper (e.g., counting, sorting, filing, and separating paper). The material from which the fingertip cover is made may provide an adequate gripping surface, such as a natural, gum or silicone rubber, or an elastomer-impregnated material, or any other material that has a high coefficient of friction relative to paper. Moreover, the surface may include additional gripping means 16 (e.g., raised or recessed dimples, grooves, indentations, grip-enhancing bumps, or the like). The gripping means 16 may substantially encompass the entire outer surface 15 or, alternately, be placed only on a portion thereof suitable for paper sorting and the like. The number, pattern, placement and orientation of the gripping means can be varied as desired. The tubular sleeve 11 may further include air holes or slits, not shown, for ventilation. The number, pattern, placement and orientation of the air holes or slits can be varied as desired.

Turning now to FIGS. 3-7, in an alternate embodiment, the finger cover 10 includes a fingernail protection portion 20. The fingernail protection portion 20 comprises a fingernail guard 21 having a substantially planar body portion having a downwardly convex curvature along the vertical edges 22 to approximate the curvature of a fingernail. The planar shape will also help the fingernail grow straight by preventing nail tips from bending inward. The fingernail guard 21 is made of resilient material to provide protection to a fingernail (natural or artificial, e.g., acrylic) and prevent breakage. The fingernail guard 21 may be made of transparent, semi-transparent, or opaque material that is resilient to protect the fingernail. For example, the fingernail guard 21 may be made of a plastic, polymer, metal, alloy, or the like. A stronger material like a metal or metal alloy may be preferred when the user is attempting more arduous tasks like house cleaning, gardening, or the like. In an embodiment, the fingernail guard 21 also includes guidelines 23 for filing/shaping of nail tips. The length and shape of the fingernail guard 21 may be easily adjusted by trimming the respective ends.

As shown in FIGS. 4-7, a user's fingernail is inserted through a horizontal slit 24 in the fingernail guard so that a distal end 25 of the fingernail guard rests under the protruding portion of a user's fingernail (free edge of nail or tip), and a proximal end 26 of the fingernail guard rests atop a user's fingernail at or about the nail base. The slit 24 may further include a rounded or padded edge (rubber, or the like), not shown, for cushioning.

The fingernail guard 21 is secured to the finger with the tubular sleeve 11 having the same or similar features as described previously with respect to FIG. 1. Specifically, the tubular sleeve 11 surrounds the proximal end 26 of the fingernail guard, securing it to the user's nail base. The tubular sleeve 11 provides dual functions of securing the fingernail guard 21 and providing a gripping surface for handling paper (as described above).

In an alternate embodiment, shown in FIGS. 4-7, the fingernail guard 21 and tubular sleeve 11 further comprise mating attachment devices 30 (31, 32). In an embodiment, the attachment devices 30 comprise one or more raised knobs 31 (protrusions) on the fingernail guard 21 that are inserted into one or more respective openings 32 in the tubular sleeve 11 to prevent slipping. Other forms of suitable attachment devices may include hook and loop material (e.g., Velcro®), mating grooves/surfaces, adhesives, bonding agents, snaps, fasteners, or the like (not shown) for temporarily or permanently attaching the fingernail guard 21 to the sleeve 11.

While there has been shown and described what is considered to be a preferred embodiment of the invention, it will, of course, be understood that various modifications and changes in form or detail could readily be made without departing from the spirit of the invention. The tightness of fit, choice of material and thickness thereof, as well as longitudinal/latitudinal dimensions may be modified in accordance with the specific requirements of a user. It is therefore, intended that the invention not be limited to the exact form and detail herein shown and described, nor to anything less than the whole of the invention herein disclosed.

The invention claimed is:

1. A finger cover for providing additional friction when handing paper comprising:

an elongated tubular sleeve having an open distal end and an open proximal end for receiving a user's finger, whereby the open distal end accommodates users with long fingernails;

a gripping surface on an outer surface of said tubular sleeve for providing additional friction when handing paper; and a fingernail protection portion attachable to said sleeve that includes a substantially horizontal slit located between distal and proximal ends thereof.

2. The finger cover of claim 1, wherein the fingernail protection portion comprises a substantially planar body portion having a downwardly convex curvature along the vertical edges to approximate the curvature of a fingernail.

3. The finger cover of claim 1, wherein the fingernail protection portion is made of resilient material to resist breakage.

4. The finger cover of claim 1, wherein the fingernail protection portion further comprises as least one visible indicator to serve as a guideline for trimming the length of the fingernail protection portion.

5. The finger cover of claim 1, wherein the slit further comprising a padded edge for cushioning.

6. The finger cover of claim 1, further comprising an attachment device.

7. The finger cover of claim 6, wherein the attachment device comprises mating attachment devices on said sleeve and said fingernail protection portion.

8. The finger cover of claim 7, wherein the mating attachment devices comprise at least one protruding knob on the proximal end of said fingernail protection portion and at least one mating opening in said sleeve.

9. The finger cover of claim 7, wherein the mating attachment devices comprise hook and loop material.

10. The finger cover of claim 7, wherein the mating attachment devices comprise frictional gripping surfaces.

11. A finger cover for providing additional friction when handing paper and protecting a user's fingernail, comprising:

an elongated tubular sleeve having an open distal end and an open proximal end for receiving a user's finger, whereby the open distal end accommodates users with long fingernails;

a gripping surface on an outer surface of said tubular sleeve for providing additional friction when handing paper; and a fingernail protection portion held in place by said sleeve comprising a substantially planar body portion having a downwardly convex curvature along the vertical edges to approximate the curvature of a fingernail; wherein the fingernail protection portion further comprises a substantially horizontal slit located between distal and proximal ends of the fingernail protection portion for insertion of a user's fingernail therethrough such that the distal end of the fingernail protection portion rests under a protruding portion of a user's fingernail and the proximal end of the fingernail protection portion rests atop a user's fingernail at or about the nail base.

* * * * *